United States Patent [19]

Hara et al.

[11] Patent Number: 4,519,878

[45] Date of Patent: May 28, 1985

[54] METHOD OF FE-ZN ALLOY ELECTROPLATING

[75] Inventors: Tomihiro Hara; Takeshi Adaniya, both of Yokohama; Akira Tonouchi, Tokyo, all of Japan

[73] Assignee: Nippon Kokan Kabushiki Kaisha, Tokyo, Japan

[21] Appl. No.: 483,564

[22] Filed: Apr. 11, 1983

[30] Foreign Application Priority Data

Apr. 14, 1982 [JP] Japan ..... 57-61112

[51] Int. Cl.[3] ..... C25D 7/06; C25D 5/10

[52] U.S. Cl. ..... 204/28; 204/40; 428/659

[58] Field of Search ..... 204/28, 40, 44.2; 428/658, 659

[56] References Cited

U.S. PATENT DOCUMENTS 4,216,272 8/1980 Clauss ..... 428/632
4,252,866 2/1981 Matsudo et al. ..... 428/659
4,310,403 1/1982 Nitto et al. ..... 204/206
4,407,899 10/1983 Hara et al. ..... 428/626

FOREIGN PATENT DOCUMENTS 56-158864 12/1981 Japan ..... 428/658

OTHER PUBLICATIONS

Abner Brenner, *Electrodeposition of Alloys,* Academic Press, New York, 1963, pp. 194–212, vol. 2.

*Primary Examiner*—G. L. Kaplan
*Assistant Examiner*—William T. Leader
*Attorney, Agent, or Firm*—Moonray Kojima

[57] ABSTRACT

A strip horizontally travels within an electroplating apparatus while the plating solution is applied between the strip and anode, in which relative speed of the solution to the strip and/or current density are varied, whereby an outer plated layer on the strip is provided with Fe-Zn alloy of high Fe content while an inner plated layer on the strip is provided with Fe-Zn alloy of low Fe content.

1 Claim, 7 Drawing Figures

METHOD OF FE-ZN ALLOY ELECTROPLATING

BRIEF DESCRIPTION OF THE INVENTION

The present invention relates to a method of forming electroplating Fe-Zn alloy layers on a surface of a steel strip where Fe content is different in each of the layers.

Steel sheet products have been required to be developed in durability, and automobile makers are desirous of improvement in properties of surface-treated steel sheets. The steel sheet should be excellent in properties after painting.

Galvanizing is a plating of thin Zn layer on a cold rolled steel sheet, and therefore formability of the galvanized sheet is the same as in the cold rolled steel sheet, but as the time passes, blisters occur on the plated steel. Due to the formation of the blister and as corrosion reaction proceeds, there occur breakouts of the paint on the layer, white rusts, red rusts or delamination of the layer. Thus function served in the plated sheet is reduced.

There is so-called "galvannealed steel sheet". The galvannealing is provided by subjecting a galvanized steel sheet to an annealing and making alloy with an iron substrate. The galvannealed sheet is not suffered by the blister, and excellent in corrosion resistance after painting. The sheet for an outer panel of the automobile is processed in such severe condition as bending, pressing, deforming and so on. Therefore the plated layer must bear those treatments. But the galvannealed Fe-Zn alloy is hard and brittle, and the layer is delaminated in powders. This is so-called "Powdering".

The galvanized steel sheet is excellent in processing but has a problem about corrosion resistance, while the galvannealed steel sheet is excellent in the latter but has a problem about the former. Thereupon the concerned field has been desirous of Fe-Zn alloy electroplated steel sheet as substitution therefor. Depending upon the electroplating process, it is convenient to undertake the plating to the strip on its side, control plating thickness or select qualities of the strip.

Many of the steel sheets for automobiles are covered by electropainting, and they are required to be also good in a secondary adhesion (this adhesion is not just after painting but long after time passing). Further when seal coat and top coat are provided on the electropainting, a part of the steel sheet not effected therewith is thin in the painted layer, so that the corrosion resistance could not be enough secured in this spot. Therefore the steel sheet should be also satisfied with the corrosion resistance in its surface per se. With respect to the secondary adhesion of the paint, the cold rolled steel sheet is eminent but has a problem about the corrosion resistance. In this regard, Fe-Zn alloy electroplated steel sheet is outstanding in the secondary paint adhesion and corrosion resistance due to Fe content in the plated layer. The layer of low Fe content is in general better in the corrosion resistance but more or less not good in the secondary paint adhesion. The layer of high Fe content is better in the latter but not good in the former.

In these circumstances, suggested is such Fe-Zn alloy electroplated steel sheet which is formed to the sheet on its surface with composite Fe-Zn alloy layers where Fe content is different in each of the layers. That is to say, an outer plated layer is provided with Fe-Zn alloy of high Fe content in order to make excellent in the secondary paint adhesion such as tipping resistance, while an inner plated layer is provided with Fe-Zn alloy of low Fe content in order to make excellent in the corrosion resistance.

When such a plated sheet is applied, as an outer panel, to the automobile, the Fe content of the outer layer will be set more than 50%, and that of the inner layer will be between 3% and 30%.

The layers of Fe-Zn alloy are formed in the following three embodiments, that is, (1) the composite layers are formed on both sides of the steel sheet, (2) composite layer is formed on one side and a single layer is formed on the other side, and (3) composite layer is formed on one side and the other side is uncoated.

For plating one side or both sides, plating baths should be different in chemical composition, pH, temperatures and other conditions. However it invites great difficulties to separately control the bath composition of more than two kinds in one processing line. In addition a conventional process could not meet the requirements for the productions of various composite plated steel sheets in response to usage as said above, and accordingly new developments therefor would be expected in the concerned field.

This invention has been created in view of the above mentioned regards, and is to provide a method of producing electroplated steel sheets of Fe-Zn alloy having different Fe contents in the plated layers without changing the chemical composition in the plating bath. For carrying out the process, the strip horizontally travels within a continuous and horizontal electroplating apparatus comprising a plurality of the plating baths, while jet of the plating solution is applied between the strip and anode where relative speed of the travelling strip to the jet of the plating solution and/or current density are altered, whereby the strip is plated with the layers of Fe-Zn alloy having the different Fe contents.

With respect to the steel sheet electroplated with Fe-Zn alloy according to a method of the invention, Fe content in an outer layer is between more than 15 wt % and not more than 60 wt % while Fe content in an inner layer is between 3 wt % and 30 wt % with different chemical composition therein from that of the upper layer.

The invention will be explained in detail with reference to the attached drawings.

DETAILED DESCRIPTION OF PREFERRED EMBODIMENTS OF THE INVENTION

The inventors made many investigations and tests on methods which could alter Fe contents in the layers placed on the strip surface with the plating bath of the same pH and chemical composition. In the continuous-horizontal electroplating apparatus, the chloride bath of

Figure 1:
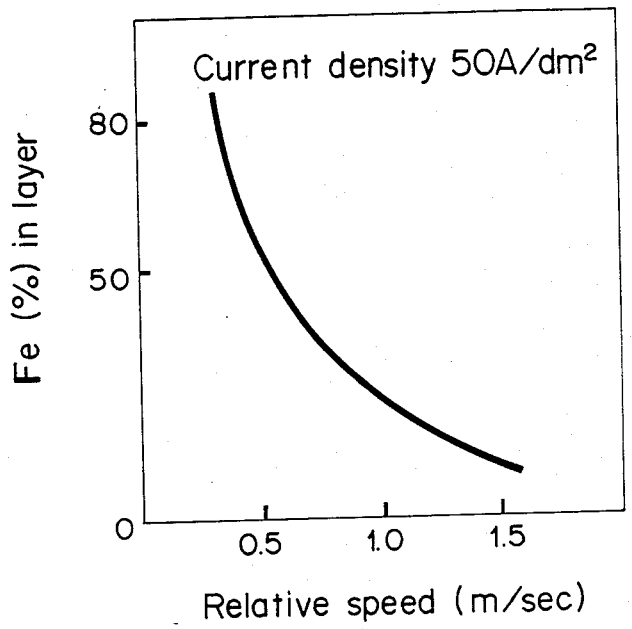
FIG. 1 is a graph showing relation between the relative speed and Fe content with respect to chloride bath.

| | | |
|---|---|---|
| composition: | ferrous chloride | 80–110 g/L |
| | zinc chloride | 190–210 g/L |
| | ammonium chloride | 250–300 g/L |
| | sodium acetate | 15–30 g/L |
| | citric acid | 5–10 g/L |
| pH: | | 2.9–3.1 |
| temperature: | | 48–52° C. |

was used at current density of 50 A/dm$^2$, and the plating bath was jetted between the running strip and anode where the relative speed therebetween was altered from 0.3 m/sec to 1.5 m/sec. Results were obtained as shown in FIG. 1. From the results it is seen that although in the same bath composition, Fe contents in the plated layers are lowered as increasing in the relative speed.

Figure 2:
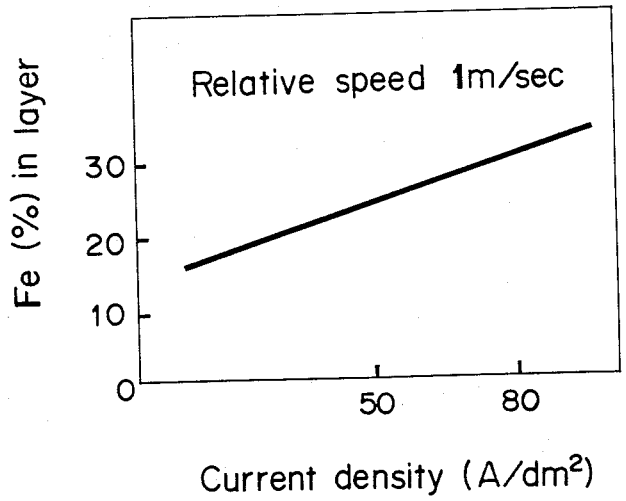
FIG. 2 is a graph showing between current density and Fe content.

FIG. 2 is a graph showing Fe(%) in the plated layer when undertaking operation at the relative speed of 1 m/sec, current density from 10 A/dm$^2$ to 95 A/dm$^2$ and in the chloride baths of the same composition, pH and temperature. From the results it is seen that Fe(%) increases as increasing in the current density.

Further, with the sulfate bath of

Figure 3:
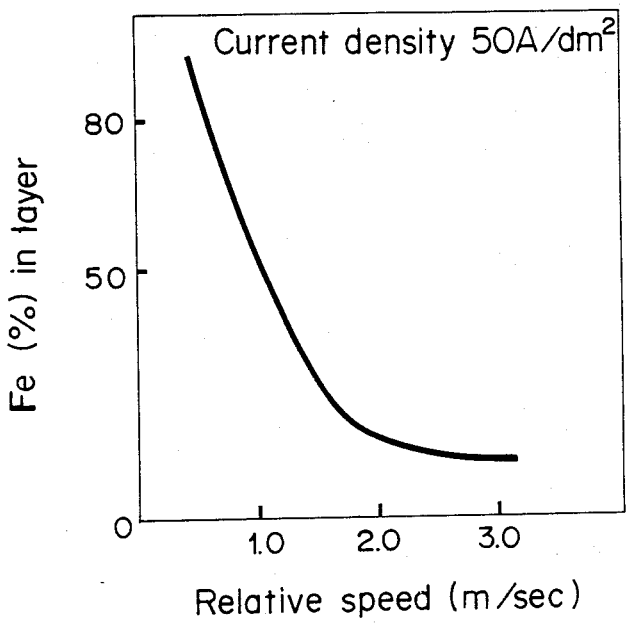
FIG. 3 is a graph showing relation between the relative speed and Fe content with respect to sulfate bath.
Figure 4:
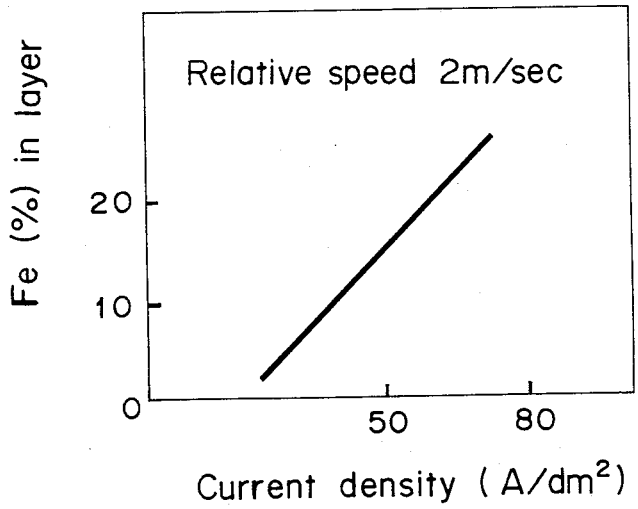
FIG. 4 is a graph showing relation between current density and Fe content.

| | | |
|---|---|---|
| composition: | ferrous sulfate | 250–300 g/L |
| | zinc sulfate | 150–200 g/L |
| | sodium sulfate | 30 g/L |
| | sodium acetate | 20 g/L |
| | citric acid | 10 g/L |
| pH: | | 2.9–3.1 |
| temperature: | | 48–52° C. |

the experiments were carried out at current density of 50 A/dm$^2$ and the relative speed from 0.4 to 3.0 m/sec, and current density from 25 to 70 A/dm$^2$ and the relative speed of 2 m/sec. Results are shown in FIGS. 3 and 4. From the result it is seen that Fe content depends upon controlling of the relative speed and current density, though the plating bath has the same composition.

Fe(%) in the plated layer could be expressed by a following experimental formula.

$$\mathrm{Fe}(\%)=av^2+bv+cI+d$$

herein, v: relative speed

I: current density (A/dm$^2$)

a, b, c, d: constants determined by bath composition and plating conditions.

Thus, in the above mentioned chloride bath, $$\mathrm{Fe}(\%)=24v^2-88v+0.2I+78$$

$0 \leqq v \leqq 2.0$ $10 \leqq I \leqq 100.$

And, in the above mentioned sulfate bath, $$\mathrm{Fe}(\%)=15v^2-80v+0.5I+90$$

$0 \leqq v \leqq 3.0$ $10 \leqq I \leqq 80$. From the results, it is seen that when the bath composition and the plating condition are determined and if the relative speed and/or current density are controlled, desired Fe(%) may be obtained.

Actual and preferred embodiments will be explained with the attached drawings.

Figure 5:
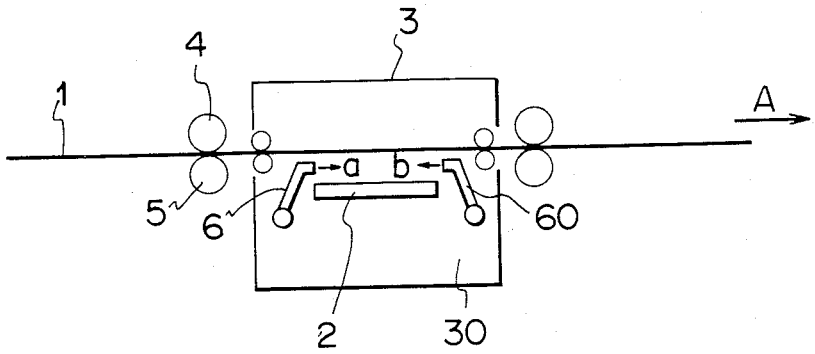
FIG. 5 is an explanatory view for an embodiment of the invention.
Figure 6:
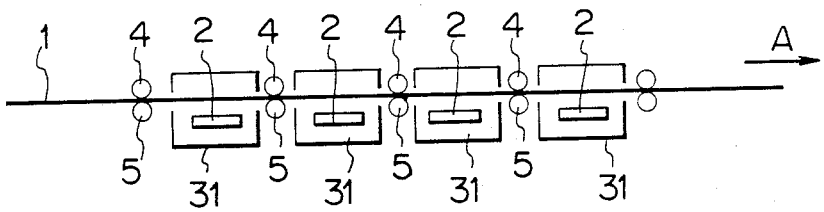
FIG. 6 is a view for explaining another embodiment.
Figure 7:
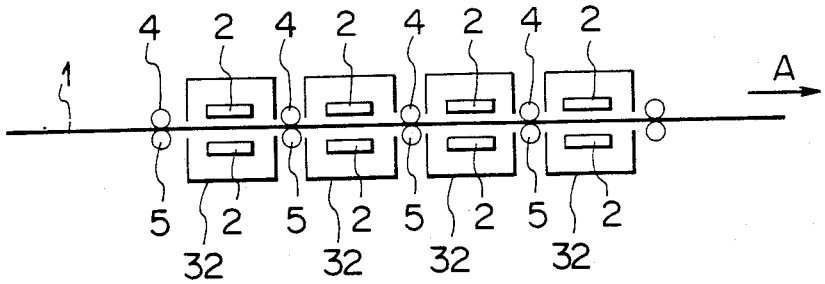
FIG. 7 is a view for explaining a further embodiment of the invention.

The continuous-horizontal electroplating apparatus 3 is used which comprises a plurality of plating chambers 30 having one side anode 2 or top and bottom anodes 2,2 as shown in FIG. 5, each of the chambers being filled with the plating bath of chloride or sulfate. Subsequently a pre-treated steel sheet is transferred between a conductor roll 4 and a backup roll 5 into the apparatus 3. Electricity is charged at minus by the conductor roll 4. If the inventive method is carried out to the strip on its one side surface only, the apparatus 3 is, as shown in FIG. 6, provided with one side electroplating chambers 31 having anodes with respect to one side of the strip 1. If the strip 1 is undertaken with the invention on its both sides, or if the strip 1 having a single layer of Fe-Zn alloy on one side is undertaken with the invention on its other side, both side electroplating chamber 32 having anodes 2,2 with respect to the both sides of the strip 1 are employed as shown.

The electric current is applied from the anode 2 to the strip 1 travelling into the chamber 30, while the plating bath is applied between the strip and the anode 2, and the relative speed between the jet speed of the bath and the travel speed of the strip and/or current density of the anode 2 are varied, so that the strip is plated on its surface with Fe-Zn alloy layers having different Fe contents.

The relative speed is changed between the apparatuses 3,3 by changing the jet speed itself, or changing the jet direction where the relative direction is made to an arrow "a" (normal) in the same direction as "A" indicating the travel direction, and it is increased if the jet direction is made to an arrow "b". The jet speed is effective within range of 0 to 3 m/sec. In case the jet is not applied, the line progressing speed of the strip 1 is relative speed. Further the jet direction is changed by using nozzles 6 or 60 in response to the plating apparatus 3.

Current density in the electroplating apparatus 3 may be varied by differentiating electric current of each of anodes 2 and/or anode area facing the strip. The scope of current density is effective in 10 to 100 A/dm$^2$.

The present invention is reduced to practice in the electroplating apparatus 3, and the post-treatment is carried out to finally produce the electroplated steel sheet of Fe-Zn alloy comprising Fe-Zn alloy layers where contents are different. If the one side of the strip is only plated with said alloy layers, the plating is carried out as the other side of the strip is covered with a shielding, or the plated layer deposited on the other side are mechanically removed. When the strip is electroplated with a single layer of Fe-Zn alloy on one side, Fe content in the plated layer may be controlled in that current density of each of anodes 2 is controlled at one side of the strip, or the plating bath is applied between the strip 1 and anode 2, and the relative speed is controlled.

The present invention will be explained more in detail with reference to Examples.

EXAMPLE 1

The chloride bath of

| | | |
|---|---|---|
| composition: | ferrous chloride | 80–110 g/L |
| | zinc chloride | 190–210 g/L |
| | ammonium chloride | 250–300 g/L |
| | sodium acetate | 15–30 g/L |
| | citric acid | 5–10 g/L |
| pH: | | 2.9–3.1 |

-continued

| | |
|---|---|
| temperature: | 48–52° C. |

was used in the continuous-horizontal electroplating apparatus, and the pre-treated strip was subjected to the electroplating by applying the chloride bath in relation with anode to provide Fe-Zn alloy. Results after treatments are shown in Table 1. In this embodiment, the other side of the strip is not plated.

Properties after painting on the Fe-Zn alloy steel sheet produced by the above mentioned process were confirmed by carrying out phosphate treatment, cation electropainting, seal coat and top coat under the following conditions.

(1) Phosphate treatment: "Bt3030" by Nippon Parker, the immersing process (2) Cation electropainting: Painted layer of 20 μm in thickness (3) Seal coat: After cation electropainting, melaninalkyd was painted in 40 μm thickness and the total thickness was 55 μm.

(4) Top coat: Melaninalkyd was painted on the test piece of the seal coat and the total thickness was 90 μm.

Properties were confirmed by the following tests.

(1) Corrosion resistance after painting: The cation electropainted test pieces were subjected to the cross-cut and the test of salt spray for 720 hours, and appearance of the blister at the cross-cut part was evaluated with the following standards.

Maximum creepage width of one side is not more than 3 mm:

Maximum creepage width of one side is from more than 3 mm to not more than 5 mm:

Maximum creepage width of one side is more than 5 mm: x (2) Wet paint adhesion: After the top coat, the test pieces were immersed in the deionized water of 40° C. for 240 hours and immediately crosshatch cut 100 lattices and 2 mm in spacing were made and tape-tested. The delaminated ones of 100 lattices by the tape-testing were evaluated with the following standards with respect to the wet paint adhesion.

Number of delaminated lattice is 0:

Number of delaminated lattice is from more than 1 to not more than 10:

Number of delaminated lattice is more than 10: x (3) Paint surface appearance: The phosphate treated test pieces were subjected to the cation electropainting for 3 min at 300 V and 300 mm distance between the electrodes, and appearing craters (pinholes) were visually observed.

Craters scarcely appeared:

Craters apparently appeared: x

The test results are shown in Table 1. No.1 of Table 1 is a reference example where Fe-Zn alloy was formed on one side of the strip under condition that current density and relative speed were kept constant in all the horizontal electroplating apparatuses. No.2 and No.3 were by the present invention, and it is seen that Fe content in each of the double layers of Fe-Zn alloy is fairly different in the calculated value and the measured value. No.2 and No.3 are excellent in the corrosion resistance after painting, but they are unsatisfactory in the painting properties such as the wet paint adhesion and the paint surface appearance which are required as the characteristics of the outer panel of the automobile but suitable to the inner panel. Since No.7 and No.8 are excellent in the paintability but more or less inferior in the corrosion resistance after painting, the sheets as the inner panel and the outer panel should be selected from No.2, No.3 or No.4 to No.6.

EXAMPLE 2

The sulfate bath of

| | | |
|---|---|---|
| composition: | ferrous sulfate | 250–300 g/L |
| | zinc sulfate | 150–200 g/L |
| | sodium sulfate | 30 g/L |
| | sodium acetate | 20 g/L |
| | citric acid | 10 g/L |
| pH: | | 2.9–3.1 |
| temperature: | | 48–52° C. |

was used as Example 1 in the continuous-horizontal electroplating apparatus and the pre-treated strip was subjected to the electroplating with the jet of plating solution on one side of the strip in relation with anode to provide Fe-Zn alloy. Results after treatments are shown in Table 2. In this embodiment, the other side of the strip is not plated. Efficiencies of the Fe-Zn alloy steel sheets produced by the above mentioned process were tested in the same way as in Example 1. The test results are shown in Table 2.

No.1 of Table 2 is a reference example where Fe-Zn alloy was formed on the side of the strip under condition that current density and relative speed were kept constant in all the horizontal electroplating apparatus. No.2 and No.3 were by the present invention, and it is seen that Fe content in each of the double layers of Fe-Zn alloy is fairly different in the calculated value and the measured value. Since No.1 to No.3 are excellent in the corrosion resistance after painting but inferior in the paintablity such as wet paint adhesion and paint surface appearance, they are suitable to the inner plate. No.4 to No.6 are excellent to the corrosion resistance after painting and the paintability, and they are suitable to the outer panel. Since No.7 and No.8 are excellent in the paintability but more or less inferior in the corrosion resistance after painting, No.1 to No.3 and No.4 to No.6 are more suitable as the inner or outer panels.

When the Example 1 and Example 2 are evaluated together with respect to the efficiency, the sheets which contain 15 to 50% Fe in the upper layer are excellent in the corrosion resistance after painting, and the sheets which contain 50 to 60% Fe in the upper layer are excellent in the corrosion resistance after painting and the paintability. Concerning the lower layer, according to the inventors' investigations, 3 to 30% Fe are necessary to secure the corrosion resistance after painting.

Depending upon the present invention it is possible to form Fe-Zn alloy layers on the surface of the steel strip where Fe contents are different, and therefore it is possible to easily produce Fe-Zn alloy electroplated steel sheet which has the plated layer excellent in the secondary paint adhesion of the plating and the plated layer excellent in the corrosion resistance of the plating, these properties being required for the steel sheets of the automobiles. As said, it is no longer necessary to vary the composition per each of the plating baths so that troubles are saved for observing the plating baths.

In the steel sheets of the composite Fe-Zn alloy layers produced by the present invention, those having the structure of the lower layer of 3 to 30% Fe and the upper layer of 15 to 50% Fe, are excellent in the corrosion resistance after painting and those having the structure of the upper layer of 50 to 60% Fe, are excellent in the corrosion resistance after painting and the paintability. Therefore, they are suitable to the inner panel and the outer panel of the automobiles.

TABLE 1

| | | First layer | | | | | | | | Second layer | | | | | | | | Characteristics | | |
|---|---|---|---|---|---|---|---|---|---|---|---|---|---|---|---|---|---|---|---|---|
| No. | A | B | C | D | E | F | G | H | I | B | C | D | E | F | G | H | I | J | K | L |
| 1 | 30 | 4 | M | 1.0 | 1.5 | 50 | 10 | 9 | 20 | 1 | M | 1.0 | 1.5 | 50 | 10 | 8 | 5 | O | x | x |
| 2 | " | 3 | " | 0.5 | 1.0 | 60 | 26 | 24 | " | 2 | " | 0.5 | 1.0 | 30 | 20 | 19 | " | | x | x |
| 3 | " | " | " | 0.7 | 1.2 | " | 19 | 18 | " | 1 | " | " | "80 | 30 | 31 | " | | O | x | |
| 4 | " | " | " | " | " | " | " | " | " | " | — | 0 | 0.5 | 40 | 48 | 50 | " | | | |
| 5 | " | " | " | " | " | " | " | " | " | " | — | " | " | 80 | 56 | 58 | " | | | |
| 6 | 90 | 11 | — | 0 | 1.5 | 50 | 10 | 8 | " | 3 | N | 1.2 | 0.3 | 50 | 64 | 63 | " | O– | | |
| 7 | 60 | 9 | — | " | 1.0 | 40 | 22 | 22 | " | 1 | " | 0.7 | " | 80 | 70 | 68 | " | O– | | |
| 8 | 30 | 4 | M | 1.0 | 1.5 | 50 | 10 | 11 | " | " | " | 0.5 | 0 | 50 | 88 | 86 | " | O | | |

Notes:
Length of electrode in tray: 2 m
A: Line speed m/min
B: Number of using trays
C: Jetting direction
D: Jetting velocity m/sec
E: Relative velocity m/sec
F: Current density A/dm$^2$
G: Fe content (%) of calculated value
H: Fe content (%) of measured value
I: Coating weight (g/m$^2$)
J: Corrosion resistance after painting
K: Wet paint adhesion
L: Paint surface appearance
M: Backward direction
N: Forward direction
: Better
O: Good
x: Bad

TABLE 2

| | | First layer | | | | | | | | Second layer | | | | | | | | Characteristics | | |
|---|---|---|---|---|---|---|---|---|---|---|---|---|---|---|---|---|---|---|---|---|
| No. | A | B | C | D | E | F | G | H | I | B | C | D | E | F | G | H | I | J | K | L |
| 1 | 30 | 4 | M | 1.0 | 1.5 | 50 | 29 | 26 | 20 | 1 | M | 1.0 | 1.5 | 50 | 29 | 27 | 5 | | x | x |
| 2 | " | 5 | " | 1.5 | 2.0 | 40 | 10 | 9 | " | " | " | 1.5 | 2.0 | 60 | 20 | 18 | " | | x | x |
| 3 | " | 6 | " | 1.0 | 1.5 | 30 | 19 | 20 | " | " | " | 1.0 | 1.5 | " | 34 | 32 | " | | O | x |
| 4 | " | " | " | " | " | " | " | " | " | " | " | 0.5 | 1.0 | " | 55 | 56 | " | | | |
| 5 | " | " | " | " | " | " | " | " | " | 2 | " | 0 | 0.5 | 20 | 64 | 60 | " | | | |
| 6 | " | 4 | " | 2.5 | 3.0 | 50 | 10 | 9 | " | 1 | — | " | " | 50 | 79 | 76 | " | O– | | |
| 7 | 90 | 11 | " | 0.5 | 2.0 | " | 15 | 14 | " | 3 | N | 1.0 | " | " | " | 75 | " | O– | | |
| 8 | 60 | 12 | — | 0 | 1.0 | 30 | 40 | 37 | " | 2 | " | 0.5 | " | 60 | 84 | 81 | " | O | | |

Notes:
Length of electrode in tray: 2 m
A: Line speed m/min
B: Number of using trays
C: Jetting direction
D: Jetting velocity m/sec
E: Relative velocity m/sec
F: Current density A/dm$^2$
G: Fe content (%) of calculated value
H: Fe content (%) of measured value
I: Coating weight (g/m$^2$)
J: Corrosion resistance after painting
K: Wet paint adhesion
L: Paint surface appearance
M: Backward direction
N: Forward direction
: Better
O: Good
x: Bad

What is claimed is:

1. A method of electroplating a steel sheet surface with at least two Fe-Zn alloy layers of different compositions; wherein said steel sheet is continuously moved horizontally through two or more chambers having anodes and plating baths therein, the composition of the baths in the different chambers, being substantially the same and also having means for applying a jet flow of said plating baths against said sheet surface while concurrently moving said sheet; and wherein the relative speed between said jet flow of said plating baths and movement of said sheet is selectively controlled to be from 0.3 to 3.0 m/sec, and current applied to said anodes is selectively controlled to provide a current density of between 10 to 100 A/dm$^2$; whereby a first layer of Fe-Zn alloy is formed on said steel sheet surface having a Fe content of between 3 to 30 weight percent, and a second layer of Fe-Zn alloy is formed on said first layer having a Fe content of between 15 to 60 weight percent, the differences in compositions of said layers being achieved by the selective varying of said relative speed and said current density without substantially changing the composition of the plating baths.

* * * * *